US009587811B2

(12) United States Patent
Kamada

(10) Patent No.: US 9,587,811 B2
(45) Date of Patent: Mar. 7, 2017

(54) LIGHT EMITTING DEVICE

(71) Applicant: NICHIA CORPORATION, Anan-shi, Tokushima (JP)

(72) Inventor: Kazuhiro Kamada, Tokushima (JP)

(73) Assignee: NICHIA CORPORATION, Anan-shi (JP)

( * ) Notice: Subject to any disclaimer, the term of this patent is extended or adjusted under 35 U.S.C. 154(b) by 72 days.

(21) Appl. No.: 14/077,321

(22) Filed: Nov. 12, 2013

(65) Prior Publication Data

US 2014/0133151 A1 May 15, 2014

(30) Foreign Application Priority Data

Nov. 13, 2012 (JP) ..... 2012-249339

(51) Int. Cl.

| | |
|---|---|
| ***F21V 21/14*** | (2006.01) |
| ***F21V 31/00*** | (2006.01) |
| ***F21V 7/22*** | (2006.01) |

(52) U.S. Cl.

CPC ..... *F21V 21/14* (2013.01); *F21S 4/22* (2016.01); *F21V 7/22* (2013.01); *F21V 31/005* (2013.01); *F21Y 2103/10* (2016.08); *F21Y 2115/10* (2016.08)

(58) Field of Classification Search

CPC ..... F21V 21/14; F21Y 2111/005
USPC ..... 313/512
See application file for complete search history.

(56) References Cited

U.S. PATENT DOCUMENTS

| | | | | |
|---|---|---|---|---|
| 5,103,382 | A * | 4/1992 | Kondo et al. | 362/503 |
| 2004/0062055 | A1* | 4/2004 | Rozenberg | F21S 8/024 362/555 |
| 2009/0140271 | A1* | 6/2009 | Sah | F21K 9/00 257/88 |
| 2010/0091496 | A1* | 4/2010 | Amoraga Rodriguez | 362/249.04 |

FOREIGN PATENT DOCUMENTS

| | | | |
|---|---|---|---|
| JP | 05-25749 | U | 4/1993 |
| JP | 2001-202803 | A | 7/2001 |
| JP | 2006-147324 | A | 6/2006 |
| JP | 2008-166462 | A | 7/2008 |
| JP | 2011-249534 | A | 12/2011 |
| JP | 2012-028232 | A | 2/2012 |
| JP | 2012-142362 | A | 7/2012 |
| JP | 2012-142382 | A | 7/2012 |
| JP | 2012-164541 | A | 8/2012 |

* cited by examiner

*Primary Examiner* — Nimeshkumar Patel
*Assistant Examiner* — Jacob R Stern
(74) *Attorney, Agent, or Firm* — Global IP Counselors, LLP

(57) ABSTRACT

A light emitting device includes a flexible substrate member having a base member and a plurality of wiring portions disposed on a surface of the base member, a plurality of light emitting elements arranged on the surface of the base member and electrically connected to the plurality of wiring portions, and a plurality of sealing members sealing corresponding parts of the substrate member and the light emitting elements respectively. The substrate is curved so that at least a part of periphery of the sealing member is arranged at a position lower than the position on which the light emitting element is disposed.

12 Claims, 13 Drawing Sheets

LIGHT EMITTING DEVICE

CROSS-REFERENCE TO RELATED APPLICATION

This application claims priority to Japanese Patent Application No. 2012-249339, filed on Nov. 13, 2012. The entire disclosure of Japanese Patent Application No. 2012-249339 is hereby incorporated herein by reference.

BACKGROUND OF THE INVENTION

1. Field of the Invention

The present disclosure relates to a light emitting device which includes a flexible substrate member and at least one light emitting element.

2. Background Information

A light emitting device having a plurality of light emitting elements mounted on a flexible substrate member has been proposed. In such a light emitting device, in order to maintain the brightness and directivity etc., each of the light emitting elements are covered with a light-transmissive resin which can exert lens effect (for example, JP H0525749U). In such a light emitting device, in order to curve the flexible substrate member in a direction parallel to the array direction of the electrically conductive pattern, wire-bonding of the light emitting elements is performed in a direction perpendicular to the array direction of the electrically conductive pattern, and thus preventing disconnection of the bonding wires and/or detachment of the light emitting elements at the time of bending/deforming of the flexible substrate member.

The light emitting device described above can realize a wide light distribution by curving the flexible substrate member in a direction parallel to the array direction of the electrically conductive pattern. That is, bending of the flexible substrate member allows altering the direction of the optical axis of each of the light emitting elements to obtain a wider light distribution as the light emitting device. Meanwhile, in the light emitting devices, a reduction in size while achieving a wide light distribution is an important task in the production of the light emitting devices. For example, in the case where an elongated lighting device such as a straight tube type fluorescent lamp to be manufactured, employing the above-described light emitting device for the built-in light emitting device allows arraignment of a plurality of light emitting elements not only in the longitudinal direction of the lighting device but also in the lateral direction of the blight emitting device. Thus, by bending the substrate member, a wide light distribution can be obtained, but it also requires a matrix arrangement of a plurality of light emitting elements which makes it difficult to achieve a reduction in the size of the light emitting device. Also, in light of directions of the optical axes of the plurality of light emitting elements arrayed in the longitudinal and lateral directions in the light emitting devices described above, uneven color emission and brightness of the light emitting device are inevitable.

SUMMARY OF THE INVENTION

It is one aim of the present invention to provide a light emitting device in which both wide distribution of light and reduction in size are achieved.

The embodiments of various aspects are described below.

In one aspect, a light emitting device includes a flexible substrate member having a base member and a plurality of wiring portions disposed on a surface of the base member, a plurality of light emitting elements disposed on the surface of the substrate member and electrically connected to the wiring portions, and a plurality of sealing members each sealing a part of the substrate member and a corresponding one of the light emitting elements. The substrate member has an elongated shape extending in a longitudinal direction. The substrate member is also in a curved state in a lateral direction which is perpendicular to the longitudinal direction, and at least a part of periphery of each sealing member is arranged at a position lower than a position on which corresponding light emitting element is disposed.

According to embodiments, a light emitting device realizing both wide distribution of light and reduction in size can be provided.

DETAILED DESCRIPTION OF THE EMBODIMENTS

Figure 1A:
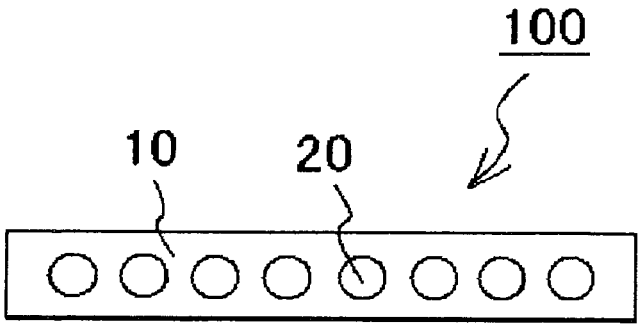
FIG. 1A is a schematic plan view showing a light emitting device according to an embodiment.
Figure 1B:
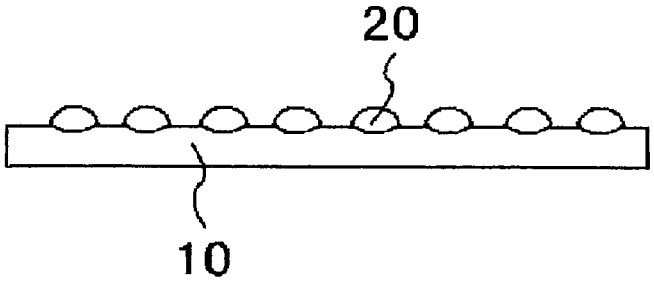
FIG. 1B is a schematic side view in a longitudinal direction of the light emitting device shown in FIG. 1A.

A light emitting device according to the present disclosure includes mainly, a substrate member, a light emitting element, and a sealing member sealing the light emitting element.

In an embodiment, a light emitting device can include a flexible substrate member having a base member and a plurality of wiring portions disposed on a surface of the base member, a plurality of light emitting elements disposed on the surface of the substrate member and electrically connected to the wiring portions, and a plurality of sealing members each sealing a part of the substrate member with corresponding one of the plurality of light emitting elements. The flexible substrate member can have an elongated shape extending in a longitudinal direction. The flexible substrate member can also be in a curved state in a lateral direction which is perpendicular to the longitudinal direction, and at least a part of periphery of each sealing member is arranged at a position lower than a position on which corresponding light emitting element is disposed.

In an embodiment, the light emitting device preferably has a fixing member to maintain the curved state of the flexible substrate member.

In an embodiment, the flexible substrate member can include a locking section respectively at both end portions in the lateral direction.

In an embodiment, the plurality of light emitting elements can be arranged in a single line in the longitudinal direction on the surface of the flexible substrate member.

In an embodiment, the flexible substrate member can be curved with a curvature radius R of about 50 mm to 3 mm.

In an embodiment, the flexible substrate member can be in a curved state in a lateral direction which is perpendicular to the longitudinal direction, and at least a part of periphery of each sealing member can be arranged at a position lower than a position on which corresponding light emitting element is disposed.

In another embodiment, a fixing member may further be provided.

In a yet other embodiment, a light emitting device may include a fixing member, which allows curving of the substrate member so that at least a part of the periphery of the sealing member is arranged at a position lower than a position on which corresponding light emitting element is disposed, or at a position lower than a surface which is a different surface of the substrate member where the light emitting element is disposed.

In a light emitting device according to a yet other embodiment, the substrate member may have an elongated shape extending in the lateral direction, and the substrate member is curved in the lateral direction which is perpendicular to the longitudinal direction. In the present specification, a surface of the substrate member, that is, a surface of the substrate member where the light emitting element is mounted may be called a "surface" and another surface of the substrate member, that is, a surface at an opposite side from the side where the wiring portions of the base member are disposed, may be called a "back-surface".

Substrate Member

A substrate member includes at least a base member, a plurality of wiring portions disposed on the base member.

Base Member

The base member is a basic component of the light emitting device and has flexibility. As long as the flexibility can be maintained, the base member can be formed by using an appropriate material according to the purpose and applications, and also in view of mounting of the light emitting element, the reflectance, adhesiveness with other members. Examples of such material include an insulating or conductive material such as plastic or metal foil. More specifically, a resin such as polyethylene terephthalate or polyimide may be preferably used. Particularly, in the case where solder is used for mounting light emitting elements, polyimide, which has high thermal resistance, is more preferably used. In addition, a material having high optical reflectance (for example, a white filler such as titanium oxide) may be contained in the material constituting the base member. The thickness of the base member can be in a range so as not to impair the flexibility, and for example, the thickness of about 10 μm to 500 μm can be employed, and about 10 μm to 200 μm or further about 10 μm to 100 μm is preferable.

The base member can be made with an appropriate shape (size, length, width) according to the aim and applications. For example, a shape such as a quadrangular shape, a rectangular shape, a polygonal shape, a circular shape, an elliptical shape, or a shape which is a combination of these shapes can be employed. In the case where the light emitting device according to an embodiment of the present disclosure is used for straight tube-type lamps, an elongated shape extending in a longitudinal direction with a length ten times or greater than the width in lateral direction may be preferably employed. For example, the ratio in the longitudinal direction to the lateral direction can be about 2 to 200:1, about 4 to 200:1, or about 5 to 200:1, which can be about 10 to 30:1 and more preferably can be about 10 to 20:1.

A flexible base member can be used in a deformed state such as in a curved or bent state. Therefore, in the case where one light emitting device to be arranged, the flexible base member having a width and length several mm to several cm larger than the width and length of the housing member of the device can be used. Also, even in the case where a plurality of light emitting devices are to be arranged, the total area of the devices can be about several mm to several cm larger than the housing member of the devices. For example, in the case of light source for straight tube-type lighting, more specifically, in the case of a straight tube-type lighting of about 120 cm in length (a 40-type), one light emitting device employing a base member of 0.5 cm to 5 cm in width, 100 cm to 150 cm in length can be used, or a plurality of light emitting devices each employing a base member of 0.5 cm to 5 cm in width, 20 cm to 70 cm in length can be used.

The base member (substrate member) having an elongated shape and flexibility can be manufactured by using roll-to-roll method, in which several units of such an elongated base member (substrate member) can be processed together.

In this case, sprocket holes may be provided in the base member.

Wiring Portion

A plurality of wiring portions are formed as electrically conductive members, disposed on one surface of the base member and directly or indirectly connected to the light emitting element. The light emitting element may be mounted on the wiring portions. The wiring portions may be made of an electrically conductive thin layer having a single-layer structure or a stacked-layer structure of metal such as copper or aluminum or alloy thereof. The wiring portions may be disposed not only on a single surface of the base member, but also an inner side or on another surface of the substrate member according to the type of the substrate member. It is preferable that the wiring portions have a thickness which does not impair their flexibility and, for example, a thickness of about 8 μm to 150 μm can be employed.

The shape (pattern) of the plurality of wiring portions is not specifically limited, and generally, a similar shape or a shape conforming to the shape or pattern of the wiring of the substrate member for mounting the light emitting elements or for connecting to the light emitting elements, or with further consideration of heat dissipation and/or mechanical strength can be preferably employed. For example, a polygonal shape such as a crank shape, a triangular shape, and a quadrangular shape, a shape with no sharp corners such as a circular shape and an elliptical shape, and a shape of those with partially irregular shape can be employed singly or in combination of two or more of those shapes. The corners of the wiring portions are preferably rounded.

The plurality of wiring portions are disposed spaced apart from each other. Such wiring portions are made up of a pair of positive and negative wiring portions, and the number of the wiring portions which constitute the pair of the wiring portions is not specifically limited. For example, each of the pair of wiring portions may be made up of a single wiring portion or a plurality of wiring portions.

The wiring portions are disposed in a relatively large area with a combination of wiring portions having various shapes, so that the degree of freedom in disposing the light emitting device can be increased. For example, with a rectangular base member, it can be possible that six wiring portions are arranged three in the longitudinal direction and two in the lateral direction as one block and connected in parallel, then, twelve blocks are arranged in the longitudinal direction and connected in series by the pair of positive and negative wiring portions. It may be such that the base member has an approximately square shape, an approximately circular shape, or an approximately elliptical shape, and one light emitting element is connected to standard positive and negative wiring portions respectively.

In addition to the wiring portions directly or indirectly electrically connected to corresponding light emitting elements (that is, the wiring portions for providing electrical continuity), a wiring portion which has a similar shape or a different shape and does not contribute to conduction of electricity and may also be disposed. The wiring portion which does not contribute to providing electrical continuity can serve as a heat releasing member or a mounting portion of the light emitting element. For example, in the case where the base member has an elongated shape extended in the longitudinal direction, the wiring portions which do not contribute to providing electrical continuity are preferably disposed extended to the longitudinal end portions and at the both sides of the wiring portions in the lateral direction. The wiring portions preferably have terminals which respectively allow supply of electricity to the wiring portions. This arrangement allows supply of electricity to light emitting elements from external power source.

In the case where a part of such wiring portions are disposed on approximately the entire surface of the flexible base member (preferably disposed without having a gap), stress due to curving of the substrate member etc., experienced on the light emitting elements and the sealing member to be described later can be reduced. Examples of such arrangements include an arrangement in which the wiring portions are disposed extending in the lateral direction of a base member having an elongated shape, and preferably, the wiring portion is disposed with a width which is about ⅓ to about equal to the width (i.e. the length in the lateral direction) of the base member.

As described above. on one surface of the base member, the plurality of wiring portions are spaced apart from each other and the separation creates grooves where the wiring portions are not disposed (in other words, portions where the base member etc., are exposed). The grooves are arranged between the wiring portions, so that the shapes of the grooves are in conformity to the shapes of the wiring portions, which may be, for example, a crank shape. The width of the grooves is preferably narrower than the width of the wiring portions, in other words, the wiring portions preferably have a large planar dimension, and for example, a width of about 0.05 mm to 5 mm may be employed.

The wiring portions (both wiring portions contribute/not contribute to electrical continuity) are preferably disposed on the base member respectively with the largest possible area, so that heat dissipation can be improved. Further, in the case where the a flexible base member is used, because the wiring portions are disposed on the whole area of one surface of the base member with relatively large areas, appropriate strength can be added while maintaining its flexibility. Thus, disconnection of wiring portions and breakage of substrate member due to bending of the flexible substrate member can be prevented effectively. More specifically, with respect to the area of the base member, the wiring portions are disposed with an area preferably 50% or greater, more preferably 70% or greater, further preferably 80% or greater, 85% or greater, or 90% or greater. Also, in the case where electrical isolation is needed between the wiring portions, in order to secure the isolation, the wiring portions are preferably disposed with the areas of about 98% or less, or 95% or less.

Covering Layer

The wiring portions are preferably covered with an insulating covering layer except for portions necessary for electrical continuity. The covering layer preferably can serve as a reflective layer to reflect the light emitted from the light emitting element.

In order to cover the wiring portions except for the portions necessary for electrical continuity, the covering layer preferably has, as described later, an opening where the wiring portions are exposed, and except for the opening, the covering layer covers approximately the entire surface of the substrate member. That is, the covering layer preferably has the opening portion to expose parts of the wiring portions for connecting the light emitting element to a pair of positive and negative wiring portions. The covering layer is preferably disposed so that portions of the pair of positive and negative wiring portions are exposed from the opening and also the groove portion described above between the wiring portions is covered.

The shape and size of the opening is not specifically limited, but a minimum size sufficient for electrical connection of the light emitting element with the wiring portions is preferable. The number of the openings provided for one substrate member is not specifically limited and for example, appropriately adjusted according to the number of the light emitting elements to be mounted on one substrate member.

Generally, the number and arrangement of light emitting elements are adjusted according to the output power, light distribution, or the like, and accordingly, the number and the positions of the openings are determined. The number of the openings can either be the same or different with respect to the number of the light emitting elements to be mounted. For example, in the case where 20 light emitting elements to be mounted with one light emitting element in one opening, 20 openings can be arranged in the covering layer. Or in the case where two or more light emitting elements to be mounted in one opening, 10 or less openings can be arranged.

In some cases, the light emitting elements may not be mounted in the openings. For example, in the case where the light emitting devices are manufactured in several ranks (for example, light emitting devices of different outputs), with the use of a common-type substrate member (that is, openings of the same number and arrangement are provided in the covering layers respectively), different optical output can be obtained by changing the number of the light emitting elements to be mounted in the openings. In this case, some openings may not have any light emitting elements mounted therein. A region lacking the covering layer (i.e. an opening) may be formed in a region for arranging a member or the like, such as the terminal described above, which supplies electricity to the light emitting elements. But portions where the wiring portions are not disposed, that is, the portions where the base member is exposed, are preferably covered with the covering layer. This is to avoid absorption of light from the light emitting element by the base member which may occur according to the kinds of the base member.

The covering layer can be formed by using a resin such as a phenol resin, an epoxy resin, a BT resin, a PPA, a silicone resin or a urea resin. Also, the covering layer is preferably made of a material which reflects emission of the light emitting element and wavelength-converted light by a wavelength converting member to be described later. For this reason, a filler such as $SiO_2$, $TiO_2$, $Al_2O_3$, $ZrO_2$, or MgO is preferably contained in the resin described above.

The covering layer is preferably disposed with a relatively small thickness, and particularly preferable that the covering layer is disposed with a thickness so that the upper surface of the light emitting element is higher than the covering layer. More specifically, the thickness of the covering layer may be about 0.5 μm to 50 μm.

The total thickness of the substrate member having the structure described above can be adjusted according to the thickness of each of the components described above, and for example, about 0.05 to 0.15 mm, preferably 0.07 to 0.12 mm can be employed. The substrate member may be formed by stacking the base member, the wiring portions, and the covering layer which are described above with applying an adhesive agent etc. (for example, a silicone-based adhesive agent, an epoxy-based adhesive agent, or an acrylic adhesive agent, with a thickness of several micrometers to several tens of micrometers) between them, or by stacking them with the use of plating, thermal compression, or the like.

The substrate member is flexible as described above, which allows its usage in various applications with a shape adapted to each application. The substrate member can be curved in any directions. For example, the substrate member can be made in a shape approximate to a hemisphere shape, an ellipsoidal shape, a semi-oval shape, or the like, and preferably curved in a direction which allows expanding the distribution of light, corresponding to the usage and propertied of the light emitting device. For this purpose, in a side view, various shapes such as a dome shape, a recessed shape, a donut shape, a wave shape, or a spiral shape can be employed. Among those shapes, a dome shape, a donut shape, or the like is preferable.

For example, in the case where the substrate member has an elongated shape extending in the longitudinal direction, the substrate member may be curved so that the edges of the substrate member in parallel to the longitudinal direction form an arch shape, but the substrate member is preferably curved so that the edges of the substrate member in parallel to the lateral direction which are perpendicular to the longitudinal direction form an arch shape. With such curvature, for example, even in the case where an elongated lighting device such as a straight tube type fluorescent lamp is to be manufactured, a wide light distribution can be realized by disposing only a single light emitting element in the lateral direction. Also, this allows adjustment of the direction of the optical axis of the light emitting element, so that unevenness in color tone and brightness of the light emitting device can be prevented. As to be described below, in order to alter the direction of the optical axis of each of the light emitting elements to obtain a wider light distribution as the light emitting device, it is necessary to provide a structure in which the substrate member is in a curved state, the sealing member to be described below is securely adhered to a part of the substrate member and the light emitting element without detaching the substrate member so that light emitted from the light emitting element can be prevented from without passing through the sealing member and leaking out.

Curvature of Substrate Member

Regardless of the diameter of each sealing member, in the case where the substrate member is in a curved state, at least a part of the periphery of the sealing member is preferably arranged at a position lower than the position on which corresponding light emitting element is disposed. In detail, in the case where the substrate member is in a curved state, at least a part of periphery of the sealing member is preferably arranged lower (the back-surface side of the substrate member which is in an uncurved state) than the lower surface of the light emitting element with the substrate member in an uncurved state, more preferably arranged lower than the surface of the substrate member at a position where the light emitting element is mounted with the substrate member in an uncurved state (for example, the surface of the covering layer, the surface of the wiring portions, the surface of the base member, etc.), and further preferably arranged at a lower position which is about the same height as the back-surface of the substrate member in an uncurved state, or arranged lower than the back-surface of the substrate member in an uncurved state.

In the specification, the term "lower" means a degree of lowerness which includes, for example, with respect to the planes of the upper surface and the back-surface of the uncurved substrate member, i.e. the thickness of the substrate member, at least a part of the periphery of the sealing member is arranged closer to the plane of the back-surface at about 20% or more, about 30% or more, about 50% or more, about 80% or more, or about 100% with respect to the thickness of the substrate member. In other words, within a range of about 20 to 500%, within a range of about 50 to 500%, within a range of about 80 to 500%, within a range of about 20 to 300%, within a range of about 80 to 300%, or within a range of about 100 to 300% with respect to the thickness of the substrate member is more preferable. From a different perspective, in a cross-sectional view of the light emitting device, the degree of curving of the substrate member is designed so that the sealing member to be described below extends about ($R-R\cdot\cos\theta$), and in this case, with respect to the thickness of the substrate member, the (R−R·cos θ) is preferably about 20% or more, about 30% or more, about 50% or more, about 80% or more, about 100% or more, about 20 to 500%, about 50 to 500%, about 80 to 500%, about 80 to 300%, about 20 to 300%, or about 100 to 300%.

From a further different perspective, the curvature of the substrate member can be made with a curvature radius (for example, "R" in FIG. 1D) of about 50 mm to 3 mm, about 40 mm or less, about 20 mm or less, or about 10 mm or less. The curving of the substrate member is preferably with a curvature radius R of 50% or more with respect to the diameter of the sealing member to be described below, and 100% or more is more preferable. Also, in the case where the substrate member has an elongated shape extending in the longitudinal direction, the curving of the substrate member may be with a curvature radius R of about 300% to 15% with respect to the lateral length of the substrate member. In the specification, the term "diameter of the sealing member" refers to the diameter of the sealing member in a plan view seen from the sealing member side, with the substrate member in an uncurved state.

Figure 12:
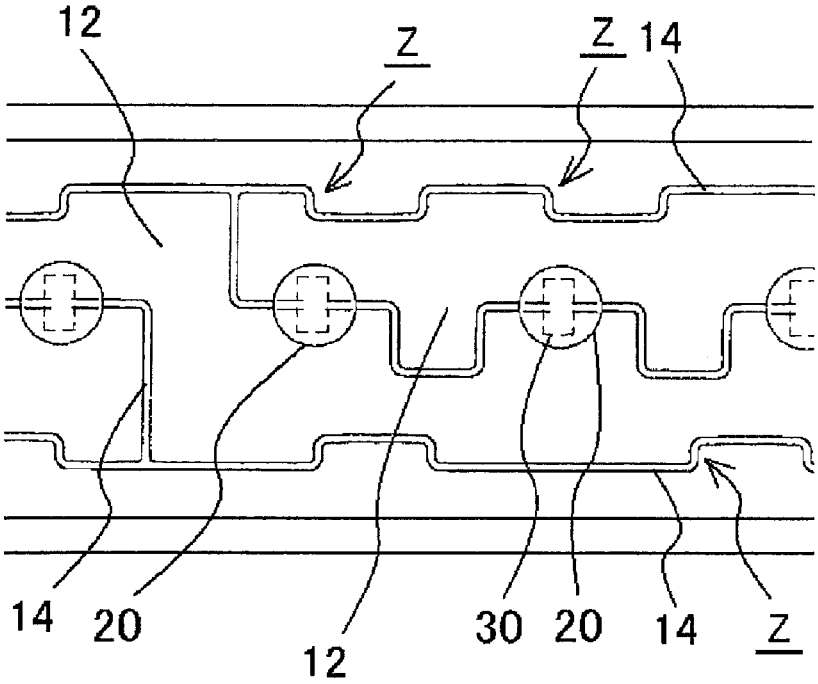
FIG. 12 is a schematic plan view illustrating a shape of a groove portion of a substrate member of a light emitting device according to an embodiment.

In the case where the substrate member is held in a curved state, the substrate member is preferably curved in a manner so that the light emitting device is neither partially nor entirely bent, that is, the light emitting device as a whole forms a gentle curve. For this purpose, for example, the shape of the wiring portions etc., is preferably adjusted. More specifically, in the case where a difference in mechanical strength which may cause curving of the base member at first, among the wiring portions and the base member, that is, in the case where the wiring portions have higher mechanical strength than the base member, reduction in the surface area of the portions where the base member having weak mechanical strength (for example, groove portions etc.) are arranged perpendicular to the curving direction, may be made. For example, as shown in FIG. 12, a configuration of the groove portion having a plurality of zigzag shapes Z can be employed for the groove portion 14 arranged between the wiring portions 12.

Maintaining of Substrate Member

Figure 4:
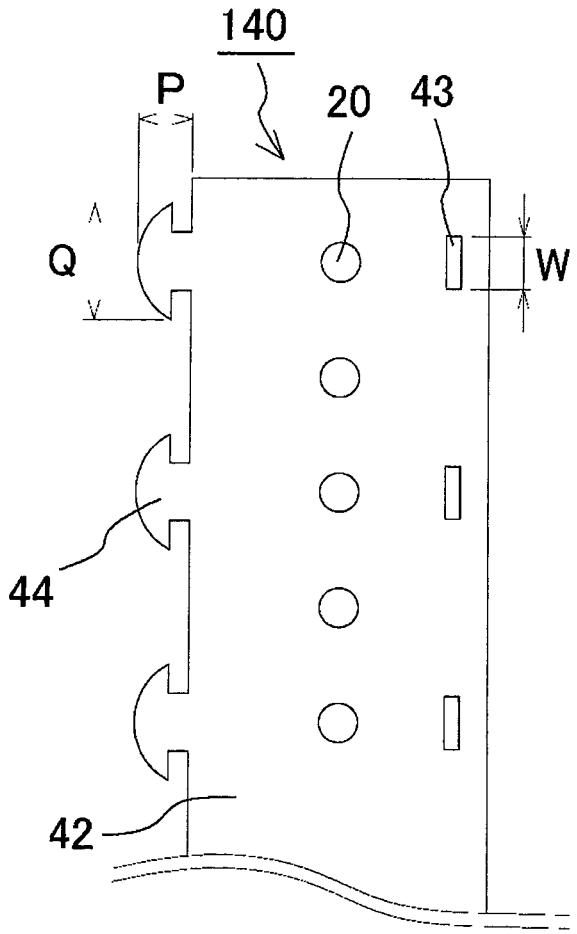
FIG. 4 is a schematic plan view of a part of a light emitting device before curving the substrate member according to a still other embodiment.
Figure 5A:
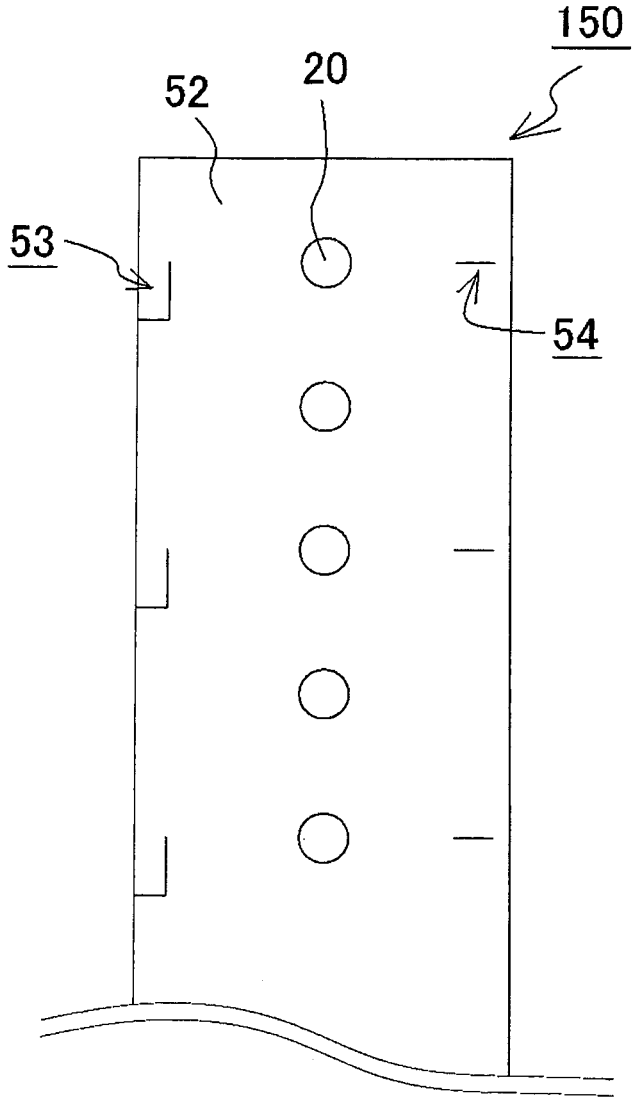
FIG. 5A is a schematic plan view of a part of a light emitting device before curving the substrate member according to a still other embodiment.
Figure 5B:
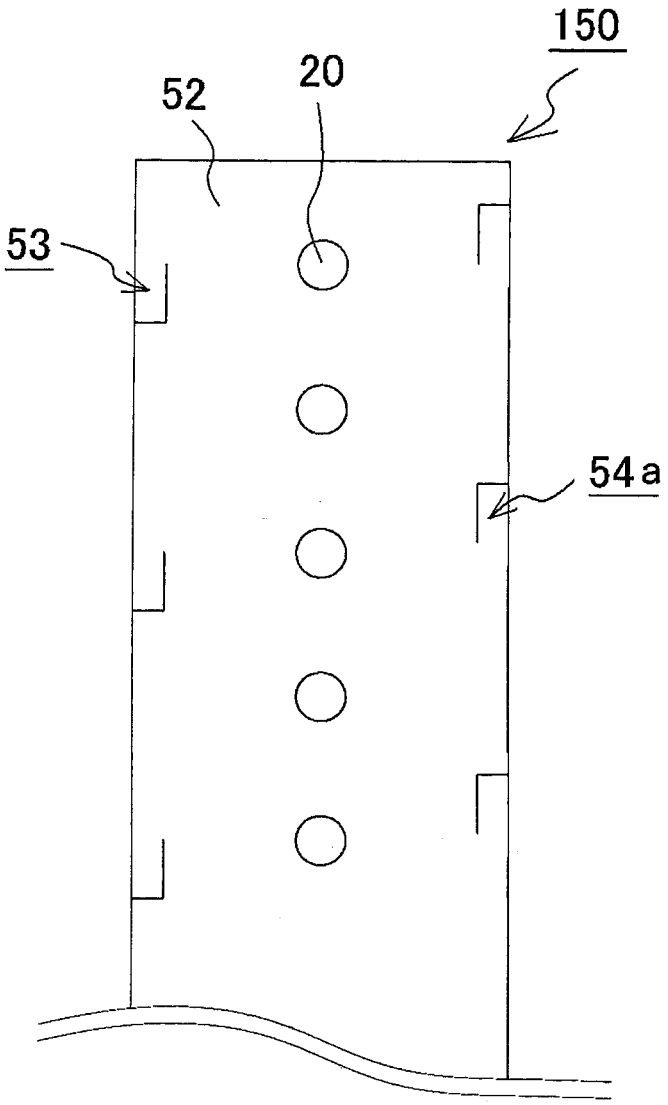
FIG. 5B is a schematic plan view of a part of a light emitting device before curving the substrate member according to a still other embodiment.
Figure 6:
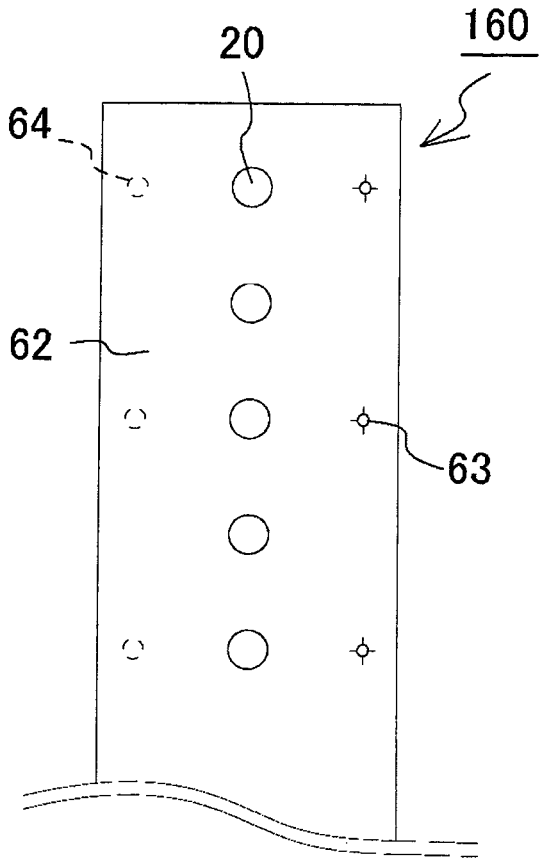
FIG. 6 is a schematic plan view of a part of a light emitting device before curving the substrate member according to a still other embodiment.

In order to maintain a curved state of the substrate member, in an embodiment, the substrate member may be provided with a locking section (see FIG. 4 to FIG. 6). Examples of the locking section include a slit, a through hole, a protruding portion, a recessed portion, and a projected portions. These locking section are disposed at an end or near an end of the substrate member so that the curved state of the substrate member can be maintained. In the specification, the term "an end portion or near an end portion" may refer to an end portion in the longitudinal direction, but preferably refers to an end portion in the lateral direction. For example, each of a pair of slits, a pair of a through hole and a projected portion, a set of a protruding portion and a recessed portion, or a set of a recessed portion and a projected portion is preferably disposed at the both end portions or near the both end portions of the substrate member respectively. Such a pair of locking section may be disposed singly in the longitudinal direction but a plural pairs of locking section are preferably disposed. Such locking section can be formed in the substrate member itself by using the substrate member itself, by, for example, forming a cut, a cut-off, or a through hole at the end portions of the substrate member, processing the shape of the end portions of the substrate member in a protruded shape and/or recessed shape, or forming a part of the surface and/or back-surface of the substrate or a part of the base member and/or covering layer with a thick layer.

Also, in order to maintain a curved state of the substrate member, in other embodiments, a fixing member for holding the substrate member may be separately used (see FIG. 7 to FIG. 11B). Examples of such a fixing member include, as described above, a support member having a curved surface having a curvature radius in conformity with the predetermined curving of the substrate member, and a member having a protruded portion, a recessed portion, a projection, a hole, a through hole, or a slit which can fix the end portion of the substrate member. Particularly, in the case where an elongated lighting device such as a straight tube type fluorescent lamp to be manufactured, a portion for disposing a protruded portion, a recessed portion, a projection, a hole, a through hole, a slit or the like which can fix the end portions of the substrate member as described above may be provided in the tube for housing the light emitting device. The material of the fixing member is not specifically limited and various materials such as plastic, glass, metal, and/or ceramics can be employed.

In order to maintain the curved state of the substrate member, in further other embodiments, both the locking section and fixing member described above may be employed.

Light Emitting Element

In the above-described opening of the covering layer on the substrate, the light emitting element may be disposed on the two wiring portions in a bridged manner or disposed on a single wiring portion. With such arrangements, the light emitting element can be electrically connected to the pair of positive and negative wiring portions respectively. Particularly, in the case where the light emitting device is disposed on the two wiring portions in a bridged manner, bending of the substrate member at the groove portion can be prevented and curving with a gentle curve can be facilitated. The number and/or tone of color tone and/or arrangement of a plurality of light emitting elements are determined to satisfy the output and light distribution designed for the light emitting device. It is therefore accordingly the shape and arrangement of the wiring portions and/or openings of the covering layer are adjusted.

Each light emitting element includes a semiconductor structure, a p-side electrode, and an n-side electrode. The semiconductor structure, for example, includes an n-type layer, an active layer, and a p-type layer respectively made of a gallium nitride-based semiconductor and stacked in the order on a light-transmissive sapphire substrate. It is not limited to a gallium nitride-based semiconductor, but also, a group II-VI based semiconductor or a group III-V based semiconductor may be used. The n-side electrode and the p-side electrode can be formed with a single layer or staked-layer of known materials.

The light emitting elements may be mounted on the substrate in a flip-chip manner or a face-up manner. In the case of flip-chip mounting, the p-side electrode and the n-side electrode of each light emitting element are connected to a pair of wiring portions via a pair of bonding member respectively. For the bonding member, for example, a solder of Sn—Ag—Cu based, Sn—Cu based, or Au—Sn based, or a metal bump such as Au can be used. Particularly, the light emitting device according to the present disclosure has a curved substrate member, so that in order to avoid disconnection of wires etc., which are connected to the light emitting elements respectively, the both positive and negative electrodes of each light emitting element are preferably firmly fixed by a bonding member to be described below, by way of flip-chip mounting. In the case of face-up mounting, the light emitting element is fixed on the base member (on the wiring portion) by an insulating bonding member such as a resin or by an electrically conductive bonding member as described above, and then, electrically connected to the wiring portions via wires. In the case where the substrate of the light emitting element is electrically conductive, the light emitting element is electrically connected by the bonding member as described above.

In addition to the light emitting elements, an electrical component (for example, related components such as a protective element such as a Zener diode or a bridge diode, a terminal for external connection described above, a fuse, and/or a resistance) may be disposed on one surface of the substrate. Such a protective element and related component may be disposed together in an opening of the covering layer where the light emitting element is mounted or in a different opening provided for them. Such members are preferably disposed at locations so as not to absorb the light from the light emitting element, and it is not necessary to dispose the same number of protective elements as the light emitting elements. Therefore, the protective element is preferably disposed at an appropriate position, for example, one protective element is mounted on a wiring portion, to which a plurality of light emitting elements are directly connected, at a position near a connector regardless of the arrangement of the light emitting elements.

The brightness of the light emitting elements can be adjusted by the structure, the constituent materials, the applied voltage, or the like. Also, the brightness of the light emitting device itself can be adjusted by increasing or decreasing the number of the light emitting elements. Thus, in the case of a straight-tube-type (40 W type) light source for lighting, the light emitting device according to the embodiments can realize a total brightness of the light emitting elements 2000 lm or greater at a color temperature of 5000K, by appropriately adjusting the type and/or the number of the light emitting elements. Accordingly, while maintaining equivalent or greater performance than the fluorescent lamps of various types such as straight-tube types, circular types, and compact types that have been conventionally used, the light emitting devices according to the embodiments can offer smaller size and weight, and can be used in various application sites or locations or conformations.

Sealing Member

The sealing members respectively sealing (covering) the light emitting elements on the substrate member, and as described above, at least a part of periphery of each sealing member is arranged at a position lower than a position on which corresponding light emitting element is disposed. One light emitting element is preferably covered with one sealing member, but two or more light emitting elements may be enclosed by one sealing member. The sealing member preferably has transparency to the light from the light emitting element and light resistance and electrical insulation properties. The sealing member is preferably disposed to cover all the openings of the covering layer described above, but may be disposed not to cover some of the openings. In the specification, the term "transparency to light" means properties of transmitting about 60% or greater emission of the light emitting element, more preferably 70% or greater or 80% or greater of light emitted from the light emitting element.

At the time of manufacturing, the light emitting device according to the present disclosure can be processed with the substrate member in a curved state. That is, the substrate member is fabricated by stacking the base member, the wiring portions and the covering layer, and the at least one light emitting element is mounted on the substrate member and electrically connected to the wiring portions, then, the at least one light emitting element etc., are covered with the sealing member. The flexible substrate member can be fabricated in a curved state and those processing can be performed with the flexible substrate member in a curved state. But generally, the substrate member is fabricated and processed in a flat state. Thus, at the time of disposing the sealing member by way of, for example, potting or printing with the flexible substrate member in a curved state, the sealing member can be disposed in conformity to the curving of the substrate member with secure adhered to the substrate. In the case where the sealing member is disposed by way of, for example, potting or printing, with the flexible substrate in a flat state, at the time of curving the substrate member, curving and/or expanding of its surface of the sealing member is required to be accurately in conformity to the shape of the substrate member so that tight adhesion of the sealing member to the substrate member can be maintained. For this, the sealing member is preferably made of a material having good adhesion to the substrate member. Also, in order to obtain tight adhesion of the sealing member to the substrate member, as described below, a material layer having good adhesion to the both may be interposed between the both.

The sealing member can be formed for example by using a silicone resin composition, a modified silicone resin composition, an epoxy resin composition, a modified epoxy resin composition, an acrylic resin composition, a silicone resin, an epoxy resin, a urea resin, a fluororesin, or a hybrid resin containing one or more of those resins.

The sealing member preferably includes a wavelength converting member such as a fluorescent material capable of absorbing light from the light emitting element and emitting light of different wavelength. Examples of such a wavelength converting member include an oxide-based fluorescent material, a sulfide-based fluorescent material, and a nitride-based fluorescent material. For example, in the case where a gallium nitride based light emitting element to emit blue light is used as the light emitting element, fluorescent materials to absorb blue light, such as a YAG-based fluorescent material or a LAG-based fluorescent material to emit yellow to green light, a SiAlON-based fluorescent material (β-sialon-based fluorescent material) to emit green light, and a SCASN-based fluorescent material and a CASN-based fluorescent material to emit red light, are preferably used singly or in combination. Also, for lighting applications, a YAG-based fluorescent material or a LAG-based fluorescent material and a SCASN-based fluorescent material or a CASN-based fluorescent material are preferably used in combination. The sealing member may contain a light diffusing agent (barium sulfate, titanium oxide, aluminum oxide, silicon oxide, or the like).

The shape of the sealing member is not specifically limited, but in view of light luminous intensity distribution and directivity of the light emitted from the light emitting element, a concave lens shape or a convex lens shape is preferably employed, and among those, a hemispherically-shaped convex lens shape is most preferably employed.

The size of the sealing member is not specifically limited and appropriately adjusted in view of the brightness, directivity, etc., of the light emitting device. Particularly, the size of the sealing member which would not impair the flexibility of the flexible substrate member is preferable. For example, the size which allows completely covering the light emitting element or greater and has a diameter or length of about twice or more with respect to the length of a side of the light emitting element is more preferable. More specifically, a side (or diameter) of about 1 mm to 4 mm can be employed. The sealing member may be disposed with its periphery arranged on the covering layer, or in the opening of the covering layer.

Figure 2:
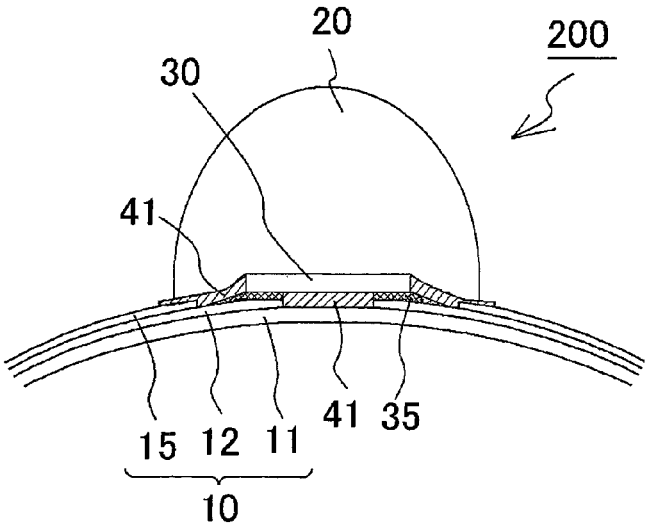
FIG. 2 is a schematic cross-sectional view in a lateral direction of a light emitting device according to another embodiment.

As long as it covers corresponding light emitting element, the sealing member may not be directly in contact with the light emitting element and may have a space between the light emitting element, or the sealing member is disposed in contact with the light emitting element over the light emitting element, but at the outer periphery of the light emitting element, the sealing member may be disposed via the resin layer, which will be described below, so as not necessarily to be directly in contact with the covering layer and the wiring portion which constitute the substrate member. For example, as shown in FIG. 2, even in the case where the periphery of the sealing member is arranged on the resin layer 41, at least a part of the periphery of the sealing member is preferably arranged at a position lower than the position on which corresponding light emitting element is disposed, as described above.

Resin Layer

As described above, in order to obtain secure adhesion of the sealing member to the substrate member, a material layer having good adhesion to the sealing member and the substrate member can be disposed in between them. In addition to secure the adhesion between the both, such a material layer may also serve other functions, and the examples of the material layer include the resin layer described below. The resin layer may be disposed laterally (outer periphery) to the light emitting element, for example, in the openings formed in the covering layer, outer periphery of the openings, or from the inner side of the openings toward the outer periphery of the openings, that is, extending onto the covering layer. Also, regardless of the presence of the wiring portions, the resin layer may be disposed, for example, in the groove portion between the wiring portions and/or directly under the light emitting element.

The resin layer is preferably in contact with the outer edge (side surfaces) of the light emitting element. Generally, the light emitting element is mounted on the substrate by using a bonding member etc., but the bonding member and/or a part of the surfaces of the base member generally tends to develop deterioration due to light, than in the material of the resin layer. For this reason, the resin layer is preferably arranged so that in the vicinity of the light emitting element, the bonding member and/or a part of the surfaces of the base member are covered with the resin layer. With this arrangement, the relatively intense light emitted from the light emitting element can be prevented from directly irradiating the bonding member and/or the base member, so that optical degradation of the constituent members of the light emitting device can be efficiently prevented.

The end portion of the resin layer at the opposite side of the light emitting element may be located either at an inner side of the outer edge, in conformity to the outer edge, or at an outer side of the outer edge of the sealing member described above. Of those, it is preferable to dispose the end portion of the resin layer in conformity to the outer edge, or at an outer side of the outer edge of the sealing member. With this arrangement, the contact area between the resin layer and the sealing member can be easily secured, so that the sealing member can be adhered more tightly to the light emitting device, particularly to the resin layer and to the substrate member.

In other words, the size of the resin layer, that is, the planar dimension of the light emitting device in light extracting direction may be similar, larger, or smaller than the planar dimension of the sealing member, excluding the planar dimension of the light emitting element. Particularly, the size of the sealing member may be about ⅕ to 3 times, preferably about ¼ to 3 times, and more preferably ⅓ to 1.5 times of the planar dimension of the sealing resin member excluding the planar dimension of the light emitting element. Thus, with a large planar dimension for disposing of the resin layer, the contact area with the sealing member increases, so that due to the adhesion of both, the adhesion of the sealing member to the substrate member in the light emitting device can be further enhanced.

The resin layer may be disposed, for example, with a thickness in a range of several μm to several hundred μm. Particularly, portions in contact with the light emitting element preferably have a thickness corresponding to or less than the height of the side surfaces of the light emitting element. In the case where the resin layer is disposed in the whole portion of the opening, the portion in contact with the periphery of the opening preferably has a thickness not exceeding the depth of the opening. Preferably the thickness of the first resin member decreases from the light emitting element outward (outer side with respect to the canter of the light emitting element).

The resin layer can be formed for example by using a resin having its base polymer of, a silicone resin composition, a modified silicone resin composition, an epoxy resin composition, a modified epoxy resin composition, an acrylic resin composition, a silicone resin, an epoxy resin, a urea resin, a fluororesin, or a hybrid resin containing one or more of those resins. Of those, a resin containing a silicone resin, an epoxy resin, or the like as its base polymer is preferable. In the specification, the term "a base polymer" means a resin having a highest content of the materials constituting the resin layer. The resin layer preferably contains, for example, a reflective material and/or diffusion material such as $SiO_2$, $TiO_2$, $Al_2O_3$, $ZrO_2$, and MgO. With this arrangement, light can be reflected sufficiently. The resin layer may be made of a single material or a combination of two or more materials. With this arrangement, the reflectance of light can be adjusted and also the linear expansion coefficient of the resin can be adjusted.

Particularly, the resin layer is preferably formed including the same polymer constituting the sealing member as described above, more preferably the base polymer constituting the resin layer includes the same polymer as in the sealing member, and further preferably the resin layer is formed with a base polymer which is the same polymer as the base polymer of the sealing member. With this arrangement, at the portion where the sealing member is in contact with the resin layer, suitability and compatibility of the both resin members are preferable, so that the adhesion with the resin layer can be further secured, and strong adhesion of the sealing member in the light emitting device, particularly to the substrate member, can be realized. As a result, even when the substrate member is held in a curved state, detachment of the sealing member from the substrate member can be prevented, which allows altering of the optical axis of the light emitting element, and further, light distribution in wider range can be realized.

The light emitting device according to the embodiments includes, as described above, a flexible substrate which uses a flexible base member, and while maintaining and/or improving the performance such as brightness and operation life time etc., required in the conventional usage, a significant downsizing and/or reduction in weight can be realized, also, further wider distribution of light can be realized and allows adjustment of the optical axis of light emitted from the light emitting element, and furthermore, uniform color tone and brightness of the light emitting device can be realized.

The embodiments according to the present disclosure will be described below with reference to the drawings.

Embodiment 1

The light emitting device 100 according to Embodiment 1 includes, as shown in FIG. 1A to FIG. 1D, the substrate 10, the light emitting elements 30 disposed on the surface of the substrate 10, and the sealing members 20 which are disposed on the substrate 10 and cover the respective light emitting elements 30.

Figure 1C:
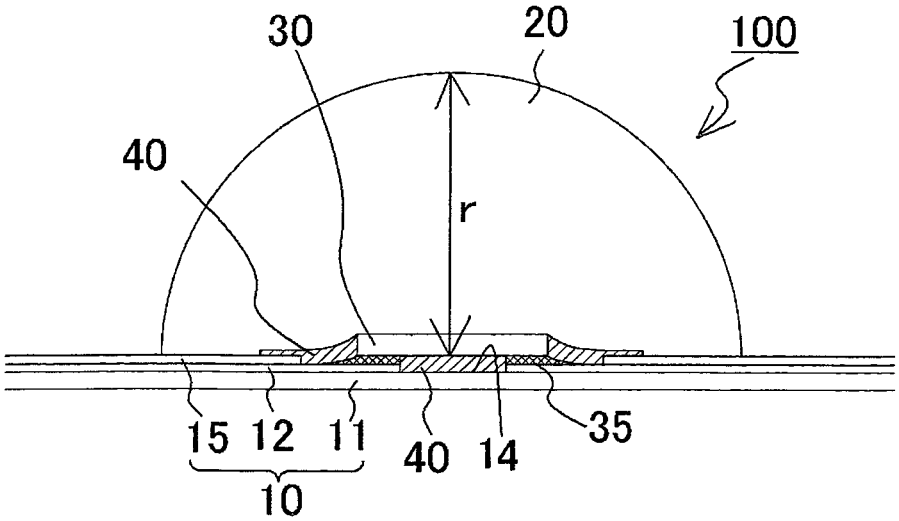
FIG. 1C is a schematic cross-sectional view in a lateral direction of a part of the light emitting device shown in FIG. 1A, before curving the substrate member.

When the substrate member 10 is in an uncurved state, as shown in FIG. 1C, the substrate member 10 has a stacked layer structure made up of a flexible base member 11 made of a polyimide (about 25 μm thickness), wiring portions 12 (about 35 μm thickness) disposed on one surface of the base member 11 and spaced apart from each other by a groove portion 14, and an insulating covering layer 15 (about 15 μm thickness and made of a silicone-based resin containing titanium oxide) disposed over them, which are stacked via an adhesive agent (a silicone-based adhesive agent). The covering layer 15 also has a reflectivity. In order to establish electrical connection with the light emitting element 30, a grove portion 14 between the wiring portions 12 and the wiring portion 12 are exposed from the covering layer 15 in a region of the substrate 10. Among the wiring portions 12, a pair of wiring portions are connected to external terminals respectively.

The light emitting element 30 includes a semiconductor structure, a p-side electrode, and an n-side electrode. In the semiconductor structure, the p-type semiconductor layer and the light emitting layer are partially removed to expose the n-type semiconductor layer, and an n-side electrode is formed on the exposed surface. A p-side electrode is formed on the upper surface of the p-type semiconductor layer. Thus, the n-side electrode and the p-side electrode are formed on the same surface side with respect to the semiconductor structure. The light emitting element 30 as described above is disposed on a pair of the wiring portions 12 which are exposed from the covering layer 15 of the substrate 10, with the surface having the n-side electrode and the p-side electrode facing downward, and is electrically connected to the wiring portions via the bonding member 35. The bonding member 35 is generally disposed spread out from the outer periphery of the light emitting element 30 to its periphery.

The resin layer 40 is disposed on the surface of the substrate 10 at a periphery of the region where the light emitting element 30 is disposed and a part of the region directly under the light emitting element 30. The resin layer 40 is, for example, made of a silicone resin containing about 30 weight % of titanium oxide. The resin member 40 is disposed from the outer periphery of the light emitting element 30 and on the bonding member 35 to the peripheral region of the light emitting element, on the all portion in the opening of the covering layer 15 and further onto a part of the covering layer 15. The thickness of the resin layer 40 can be approximately the same as the height of the light emitting element 30 at the light emitting element 30 side, and can be gradually reduced on the bonding member 35 to reach about 10 μm thickness on the covering layer 15. The length from the end portion of the resin layer 40 at the light emitting element 30 side to the end portion at the opposite side is about 1 mm. In the case where the resin layer 40 is disposed at the outer periphery of the light emitting element 30 with a relatively large area, the sealing member 20 generally having a poor adhesion with the bonding member 35 and the wiring portions 12 etc., can be made in contact with the resin layer 40 which has better adhesion with those, at a larger contact area, so that the sealing member 20 can be firmly adhered to the substrate member 10. The resin layer 40 has a reflectance higher than that of the bonding member 35 and the wiring portion 12, so that extraction of light from the light emitting element can be performed more efficiently.

The sealing member 20 is disposed on the substrate 10 mounted with the light emitting element 30, on the portions including the light emitting element 30, the resin layer 40 disposed around the light emitting element 30, and a portion of the covering layer 15 disposed from directly under the resin layer 40 on the covering layer 15 arranged on an outer side of the light emitting element 30. The sealing member 20 is, for example, made of a silicone resin containing about 10 weight % of a fluorescent material (LAG·SCASN). That is, the sealing member 20 contains the same type of polymer used to make the resin layer. The periphery of the sealing member 20 is arranged on the covering layer 15 of the substrate member 10. The sealing member 20 is formed in a hemispherical shape by way of potting on the substrate member 10 in a flat state. The diameter r of the sealing member 20 is, for example about 3.5 mm when the substrate member 10 is in an uncurved state.

Figure 1D:
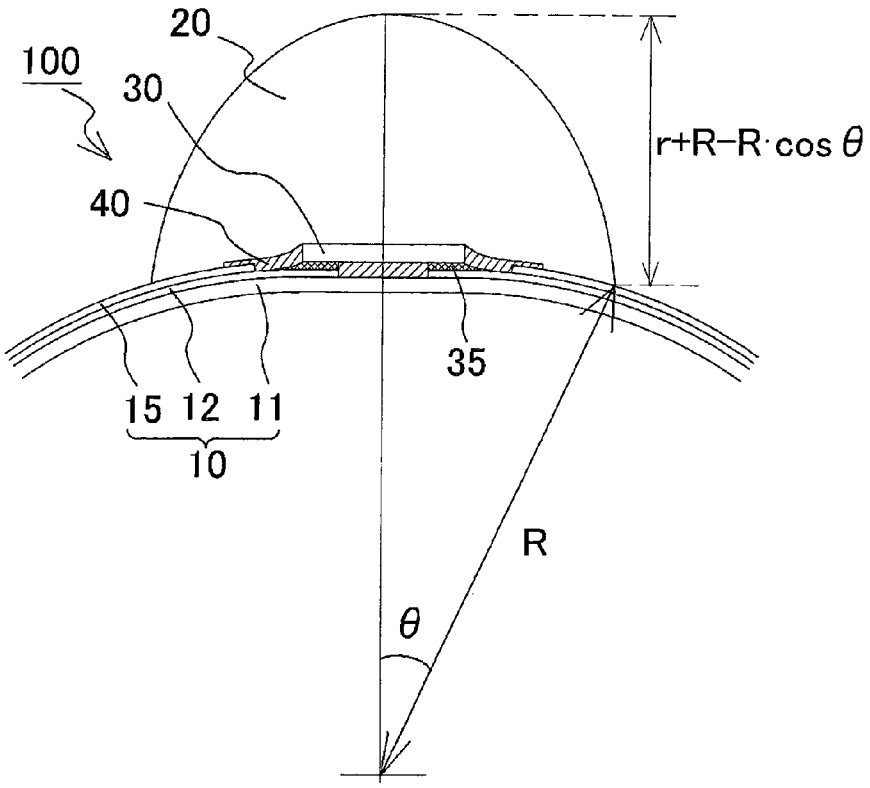
FIG. 1D is a schematic cross-sectional view in a lateral direction of a part of the light emitting device shown in FIG. 1A, after curving the substrate member.

When the substrate member 10 is in a curved state, as shown in FIG. 1D, the substrate member 10 is held so that at least a part of the periphery of the sealing member is disposed at a position lower than the position on which corresponding light emitting element is disposed. That is, corresponding to the curving of the substrate member 10, the surface of the sealing member 20 expands, so that a part of the periphery of the sealing member 20 is located at a position lower than a part of the back-surface of the substrate member 10 corresponding to the portion on which the light emitting element 30 is disposed (at a position lower than the lower surface of the light emitting element toward the back-surface side of the substrate member 10). The state of curving is maintained by, for example, attaching the substrate member 10 of the light emitting device on a cylindrical fixing member having a curvature radius R (for example, see "83" in FIG. 8). With this arrangement, the aspect ratio (radius:height) of the sealing member 20 is $r:r+R-R\cdot\cos\theta$. Here, "r" is a radius of the sealing member 20 in a cross-sectional view.

With the structure as described above, the light emitting device 100 allows, for example, a wider distribution of light of each light emitting element by $(R-R\cdot\cos\theta)$ as shown in FIG. 1D.

As described above, because the resin layer 40 is disposed with a relatively wide surface area, even when the substrate member 10 is held in a curved state, the sealing member 20 can be made in conformity to the curving of the substrate member 10 and firmly adhered to the substrate member 10.

That is, the sealing member 20 is disposed containing the same base polymer as in the resin layer 40, thus, the adhesion between the both can be secured.

Embodiment 2

A light emitting device 200 according to Embodiment 2 includes a substantially same structure as the light emitting device 100, except, for example, as shown in FIG. 2, periphery of the sealing member 20 is disposed on the resin layer 41 reaching on the covering layer 15 of the substrate member 10. That is, periphery of the sealing member 20 of the light emitting device 200 is arranged over the covering layer 15 via the resin layer 41, but even so, the periphery of the sealing member 20 is still at a position lower than the portion of the back-surface of the substrate member 10 which corresponds to the portion of the substrate member 10 on which the light emitting element 30 is disposed (a position at the back-surface side of the substrate member 10 than the lower surface of the light emitting element). The diameter of the sealing member 20 is, for example about 3.5 mm when the substrate member 10 is in an uncurved state. The light emitting device 120 can also provide generally the same effects as that of the light emitting device 100 shown in Embodiment 1. As described above, the sealing member 20 is in contact with the resin layer 41 at a large surface area without contacting the covering layer 15, a greater contact area of the both can be secured. Particularly, in the case where the resin layer 41 is formed with the same polymer as the base polymer which constitutes the sealing member 2, good suitability and compatibility of the both can be obtained and thus further firm adhesion can be realized. Moreover, the surfaces and the interface between the bonding member 35 and the wiring portion 12 and the interface between the wiring portion 12 and the covering layer 15 can be covered with the resin layer 41, so that optical degradation of those members and detachment or the like, due to the optical degradation can be effectively prevented.

Embodiment 3

Figure 3:
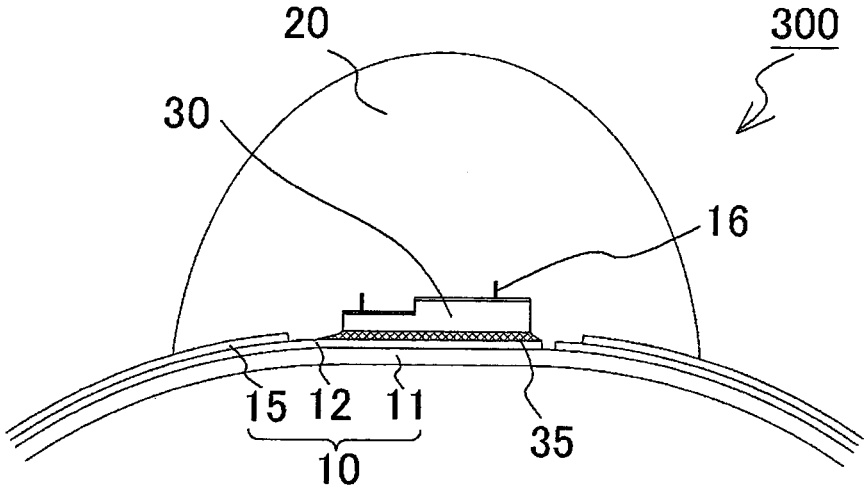
FIG. 3 is a schematic cross-sectional view in a lateral direction of a light emitting device according to a still other embodiment.

A light emitting device 300 according to Embodiment 3 includes a substantially same structure as the light emitting device 100, except, for example, as shown in FIG. 3, the light emitting element 30 is mounted in a face-up manner, the n-side electrode and the p-side electrode of the light emitting element 30 are respectively electrically connected to the wiring portions 12 via wires 16. The extending direction of the wires 16 is substantially parallel to the longitudinal direction of the substrate member 10. The light emitting device 300 also exhibits the same level of effects as that with the light emitting device 100 of Embodiment 1. Further, the wires 16 are extending in a different direction from the curving direction of the substrate member 10, so that disconnection of the wires etc., can be prevented. Moreover, the side surfaces of the light emitting element, the base member exposed from the openings, surfaces of the wiring portions etc., may be covered with a resin layer.

The resin layer may be disposed at connecting portions of the wires 16 and the wiring portions 12 at the periphery of each light emitting element 30. This arrangement allows covering of the wires 16 and the wiring portions 12 with the resin layer 40, so that optical degradation of those portions, detachment and breaking due to optical degradation of those portions can be efficiently prevented.

Embodiment 4

A light emitting device 140 according to Embodiment 4 includes a substantially same structure as the light emitting device 100, except, for example, as shown in FIG. 4, the light emitting device includes a locking section which has a plurality of through holes 43 extending in the longitudinal direction with a width W at one end in the longitudinal direction of the substrate member 42, and corresponding a plurality of protruding portions 44 each having a width Q in the longitudinal direction of the substrate member 42 which is smaller than the width W of the corresponding through hole 43 and a length P in the lateral direction which allows the protruding portion to penetrate through the through hole 43, so that the substrate member 42 is held in a curved shape by engaging the protruding portions 44 with the through holes 43. The light emitting device 140 can also provide generally the same effects as that of the light emitting device 100 shown in Embodiment 1.

Embodiment 5

A light emitting device 150 according to Embodiment 5 includes a substantially same structure as the light emitting device 100, except, for example, as shown in FIG. 5A, the light emitting device 150 includes a locking section which has a plurality of hook shape cuts 53 at one end and corresponding a plurality of linear cuts 54 at the other end for engaging the hook shape cuts along the longitudinal direction of the substrate member 52, so that the substrate member 52 is held in an curved shape by engaging the hook shape cuts 53 and the linear cuts 54. In this case, instead of the linear cuts 54, as shown in FIG. 5B, cuts 54*a* having the same shape as the hook shape cuts 53 but formed along a different direction than that of the hook shape cuts 53 may be formed. The light emitting device 160 can also provide generally the same effects as that of the light emitting device 100 shown in Embodiment 1.

Embodiment 6

A light emitting device 160 according to Embodiment 6 includes a substantially same structure as the light emitting device 100, except that the light emitting device 160 includes a locking section which has, for example, as shown in FIG. 6, a plurality of through holes 63 formed along one end in the longitudinal direction of the substrate member 62, and a plurality of corresponding protruding portions 64 which are larger than the through holes 63 are formed at the back-surface side along the other end in the longitudinal direction of the substrate member 62, so that the substrate member 62 is held in a curved shape by pressing the protruding portions 64 in the corresponding through holes 63. The protruding portions 64 can be formed, for example, by forming a part of the base member 11 with a thick layer or by potting a material similar to that of the sealing member in a similar manner. Further, the through holes 63 respectively have cuts in four directions for pressing in and fixing the protruding portions 64 having a larger size than the diameter of the through holes 63. The light emitting device 160 can also provide generally the same effects as that of the light emitting device 100 shown in Embodiment 1.

Embodiment 7

Figure 7:
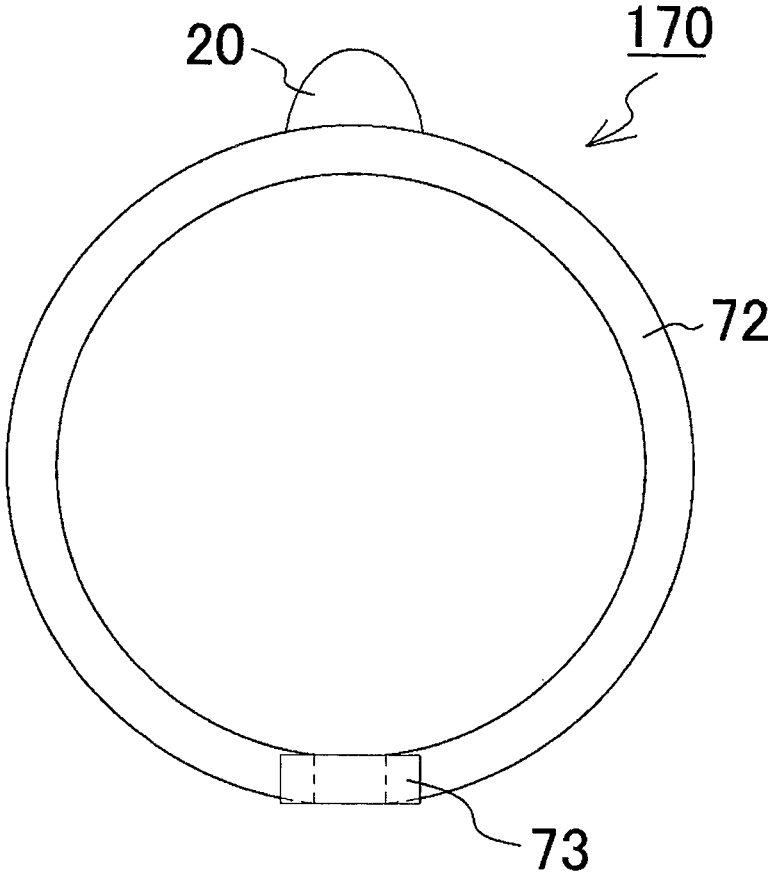
FIG. 7 is a schematic side view in a lateral direction of a light emitting device after curving the substrate member, according to a still other embodiment.

A light emitting device 170 according to Embodiment 7 includes a substantially same structure as the light emitting device 100, except, for example, as shown in FIG. 7, as a fixing member, an adhesive tape (or a staple) 73 is applied at the both lateral ends of the substrate member 72 to hold the substrate member 72 in a curved shape. The light emitting device 170 can also provide generally the same effects as that of the light emitting device 100 shown in Embodiment 1.

Embodiment 8

Figure 8:
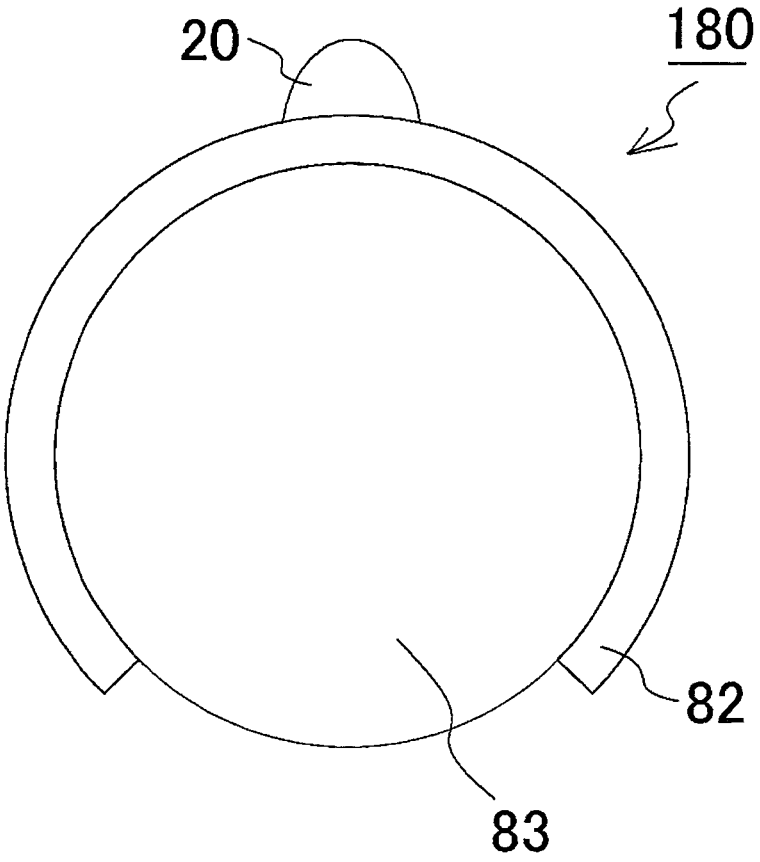
FIG. 8 is a schematic side view in a lateral direction of a light emitting device after curving the substrate member, according to a still other embodiment.

A light emitting device 180 according to Embodiment 8 includes a substantially same structure as the light emitting device 100, except, for example, as shown in FIG. 8, as a fixing member 83, a cylindrical fixing member having a radius R is used, and a double-faced adhesive tape is applied on the back-surface of the substrate member 82, then, the substrate member 82 is adhered on the side surface of the fixing member 83 by the adhesive tape to hold the substrate member 82 in a curved shape. The light emitting device 180 can also provide generally the same effects as that of the light emitting device 100 shown in Embodiment 1.

Embodiment 9

Figure 9:
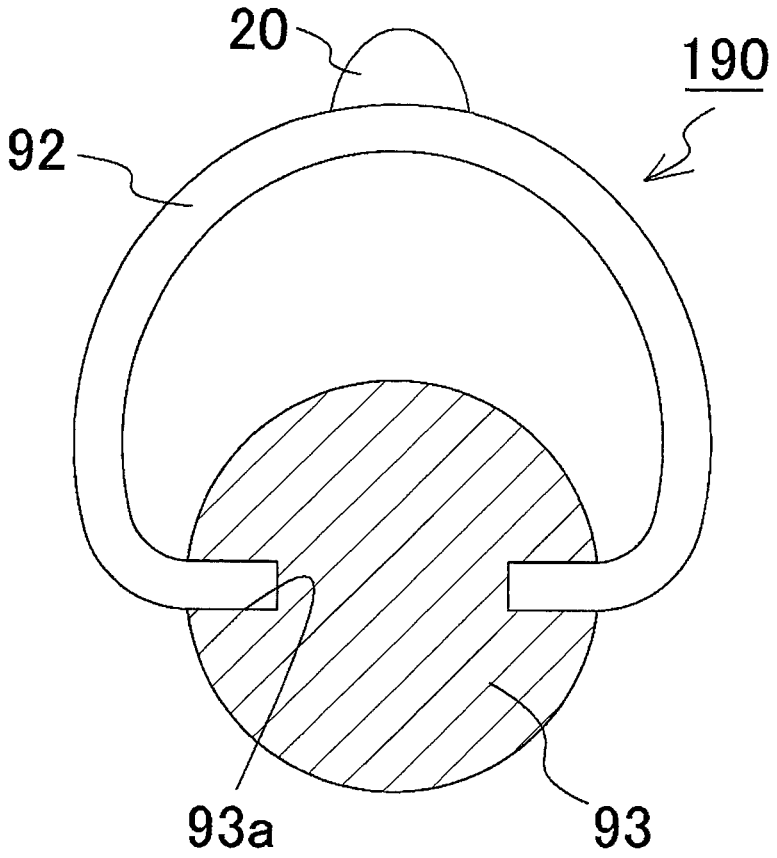
FIG. 9 is a schematic side view in a lateral direction of a light emitting device after curving the substrate member, according to a still other embodiment.

A light emitting device 190 according to Embodiment 9 includes a substantially same structure as the light emitting device 100, except, for example as shown in FIG. 9, as a fixing member 93, a cylindrical fixing member having a radius R and two slits 93 formed in the radius direction and in parallel to each other along the extending direction of the cylinder is used, and the both lateral ends of the substrate member 92 are respectively inserted in the two slits 93*a* to hold the substrate member 92 in a curved shape. The light emitting device 190 can also provide generally the same effects as that of the light emitting device 100 shown in Embodiment 1.

Embodiment 10

Figure 10:
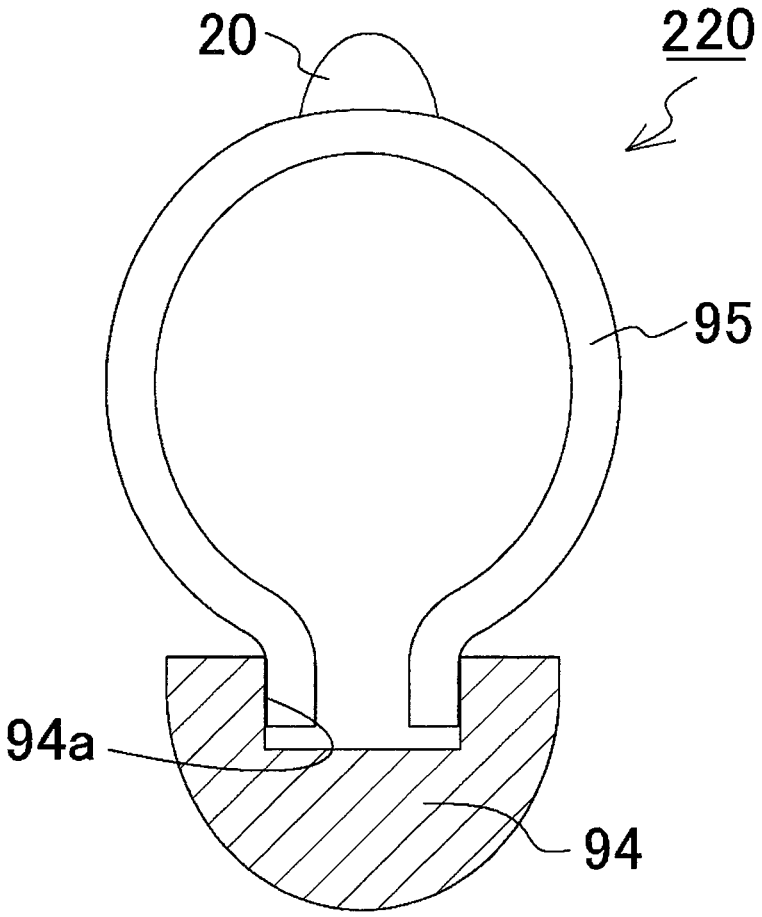
FIG. 10 is a schematic side view in a lateral direction of a light emitting device after curving the substrate member, according to a still other embodiment.

A light emitting device 220 according to Embodiment 10 includes a substantially same structure as the light emitting device 100, except, for example as shown in FIG. 10, as a fixing member 94, using a fixing member having a semicircular column shape with a recessed groove 94*a* with a width smaller than the lateral length of the substrate member 95 (for example, a ½ width) on a surface, the both lateral ends of the substrate member 95 are pushed in the recessed groove 94*a* to hold the substrate member 95 in a curved shape. The light emitting device 190 can also provide generally the same effects as that of the light emitting device 100 shown in Embodiment 1.

Embodiment 11

Figure 11A:
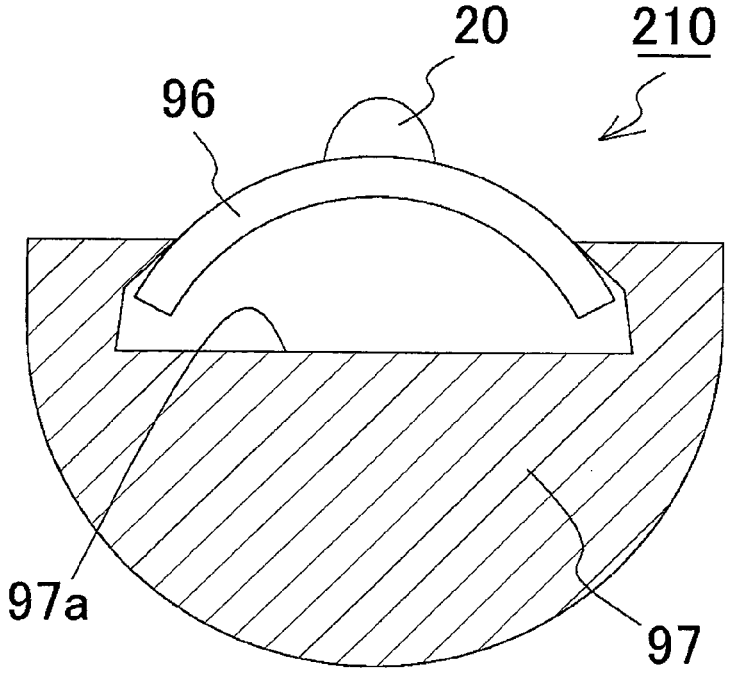
FIG. 11A is a schematic side view in a lateral direction of a light emitting device after curving the substrate member, according to a still other embodiment.
Figure 11B:
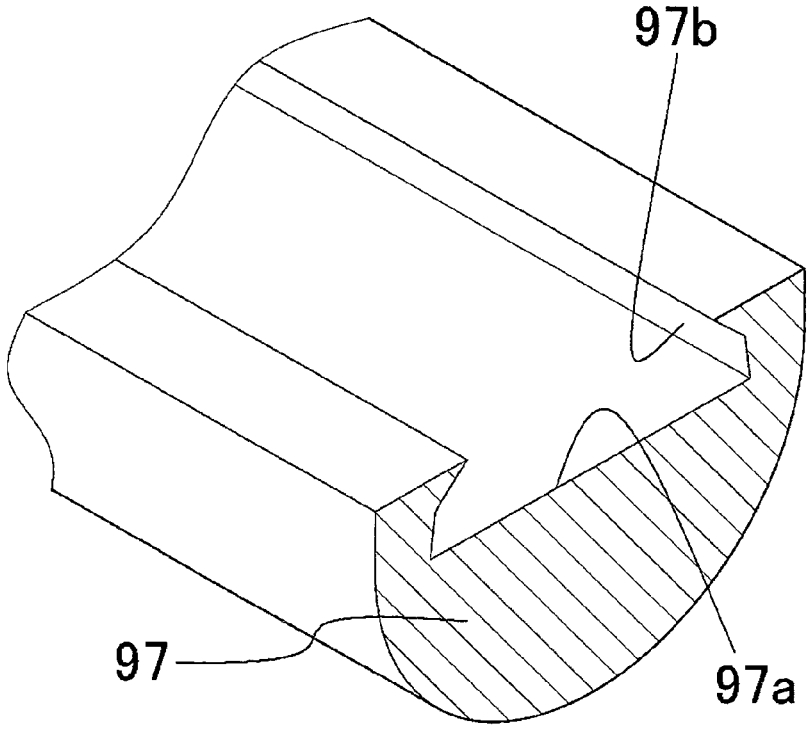
FIG. 11B is a perspective view of a part of a fixing member of the light emitting device shown in FIG. 11A.

The light emitting device 210 of Embodiment 11 includes a substantially same structure as the light emitting device 100, except, for example, as shown in FIGS. 11A and 11B, as a fixing member 97, using a fixing member having a semicircular column shape with a recessed groove 97*a* with a width smaller than the lateral length of the substrate member 96 (for example, a ⅘ width) on a surface, the both lateral ends of the substrate member 96 are pushed in the recessed groove 97*a* to hold the substrate member 96 in a curved shape. In this case, the recessed groove 97*a* may be defined by planar, parallel side surfaces or by side surfaces tapering toward the bottom of the recessed groove 97*a*, or as shown in FIG. 11B, by the side surfaces each further having recessed portion 97*b* at the bottom surface side so that the end portions of the substrate 96 are caught by the recessed portion 97*b* which prevents easy detachment of the substrate member 96. The height of the recessed portion 97*b* is greater than the thickness of the substrate member 96, and the narrower the width of the groove 97*a* the greater the hold of the substrate member 96 in a curved state can be achieved. The light emitting device 210 exhibits the same level of effects as that with the light emitting device 100 of Embodiment 1.

The light emitting device according to the present invention can be used for various kinds of light sources, such as illumination light sources, light sources for various kinds of indicators, light sources for automobile use, light sources for displays, back light sources for liquid crystal displays, light sources for sensors, signals, automobile use, channel control characters for channel boards. The light emitting device 210 can also provide generally the same effects as that of the light emitting device 100 shown in Embodiment 1.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A light emitting device comprising:

a flexible substrate member having a base member and a pair of wiring portions disposed on a surface of the base member with a groove being defined between the pair of wiring portions;

a plurality of light emitting elements disposed on the surface of the base member and electrically connected to the pair of wiring portions with each of the light emitting elements being mounted on the pair of wiring portions in a flip-chip manner with the groove being arranged under each of the light emitting elements; and a plurality of sealing members each sealing a part of the base member and a corresponding one of the light emitting elements, the substrate member having an elongated shape extending in a longitudinal direction, and the substrate member being in a curved state in a lateral direction which is perpendicular to the longitudinal direction, a length of the substrate in the longitudinal direction being longer than a width of the substrate in the lateral direction, and at least a part of periphery of each of the sealing members, which is disposed on the pair of wiring portions on which a corresponding one of the light emitting elements is arranged, being positioned lower than an upper surface of the pair of wiring portions with respect to the lateral direction, and the groove arranged under each of the light emitting elements extending along the longitudinal direction.

2. The light emitting device according to claim 1, further comprising a fixing member configured to maintain the curved state of the substrate member.

3. The light emitting device according to claim 1, wherein the substrate member has a locking section respectively at both end portions in the lateral direction.

4. The light emitting device according to claim 1, wherein the light emitting elements are arranged in a single line in the longitudinal direction on the surface of the substrate member.

5. The light emitting device according to claim 1, wherein the substrate member is curved with a curvature radius R of about 50 mm to 3 mm.

6. The light emitting device according to claim 2, wherein the fixing member includes one of a protruded portion, a recessed portion, a projection, a hole, a through hole, and a slit.

7. The light emitting device according to claim 3, wherein the locking section includes one of a protruded portion, a recessed portion, a projection, a hole, a through hole, and a slit.

8. The light emitting device according to claim 1, wherein at least a part of the periphery of the sealing member is arranged on a covering layer.

9. A light emitting device comprising:

a flexible substrate member having a base member and a pair of wiring portions disposed on a surface of the base member with a groove being defined between the pair of wiring portions, the substrate member having an elongated shape extending in a longitudinal direction, a length of the substrate in the longitudinal direction being longer than a width of the substrate in the lateral direction, and the substrate member being in a curved state in a lateral direction which is perpendicular to the longitudinal direction;

a plurality of light emitting elements disposed on the surface of the base member and electrically connected to the pair of wiring portions with each of the light emitting elements being mounted on the pair of wiring portions in a flip-chip manner with the groove being arranged under each of the light emitting elements; and a plurality of sealing members each sealing a part of the base member and a corresponding one of the light emitting elements, the substrate member having a fixing member configured to maintain the curved state of the substrate member, and the groove arranged under each of the light emitting elements extending along the longitudinal direction.

10. The light emitting device according to claim 9, wherein the fixing member includes one of a protruded portion, a recessed portion, a projection, a hole, a through hole, and a slit.

11. A light emitting device comprising:

a flexible substrate member having a base member and a pair of wiring portions disposed on a surface of the base member with a groove being defined between the pair of wiring portions, the substrate member having an elongated shape extending in a longitudinal direction, a length of the substrate in the longitudinal direction being longer than a width of the substrate in the lateral direction, and the substrate member being in a curved state in a lateral direction which is perpendicular to the longitudinal direction;

a plurality of light emitting elements disposed on the surface of the base member and electrically connected to the pair of wiring portions with each of the light emitting elements being mounted on the pair of wiring portions in a flip-chip manner with the groove being arranged under each of the light emitting elements; and a plurality of sealing members each sealing a part of the base member and a corresponding one of the light emitting elements, the substrate member having a locking section respectively at both end portions in a lateral direction, and the groove arranged under each of the light emitting elements extending along the longitudinal direction.

12. The light emitting device according to claim 11, wherein the locking section includes one of a protruded portion, a recessed portion, a projection, a hole, a through hole, and a slit.

* * * * *